US006828494B2

(12) United States Patent
Toda

(10) Patent No.: US 6,828,494 B2
(45) Date of Patent: Dec. 7, 2004

(54) RUBBER PAD FOR ELECTRONIC PERCUSSION INSTRUMENT AND MANUFACTURING METHOD THEREFOR

(75) Inventor: Jiro Toda, Hamamatsu (JP)

(73) Assignee: Yamaha Corporation (JP)

( * ) Notice: Subject to any disclaimer, the term of this patent is extended or adjusted under 35 U.S.C. 154(b) by 58 days.

(21) Appl. No.: 10/408,094

(22) Filed: Apr. 8, 2003

(65) Prior Publication Data

US 2003/0188624 A1 Oct. 9, 2003

(30) Foreign Application Priority Data

Apr. 9, 2002 (JP) ..... P2002-106660

(51) Int. Cl.[7] ..... G10D 13/02
(52) U.S. Cl. ..... 84/411 R; 84/411 P; 84/411 M
(58) Field of Search ..... 84/411 R, 411 P, 84/411 M

(56) References Cited

U.S. PATENT DOCUMENTS

D319,650 S * 9/1991 Hart ..... D17/22
5,583,307 A * 12/1996 Tobia, Jr. ..... 84/411 R
6,063,992 A * 5/2000 Schwagerl ..... 84/411 P

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A rubber pad for an electronic percussion instrument is produced by integrally forming together a pad portion (including a striking surface) and a rim portion, which are colored differently in two-colored formation. In manufacture, the rubber pad is produced by a single press formation using a specially designed metal mold in which a partition wall is arranged between a pad forming cavity and a rim forming cavity, into which rubbers of different colors are respectively put. Therefore, a groove corresponding to the partition wall is formed in a boundary between the pad portion and rim portion, which are integrally interconnected together and are colored differently. Due to the provision of the groove, it is possible to reliably separate different colored regions, i.e., the pad portion and rim portion, from each other. Thus, it is possible to improve external appearance of the rubber pad without substantially deteriorating durability thereof.

5 Claims, 4 Drawing Sheets

RUBBER PAD FOR ELECTRONIC PERCUSSION INSTRUMENT AND MANUFACTURING METHOD THEREFOR

BACKGROUND OF THE INVENTION

1. Field of the Invention

This invention relates to rubber pads for electronic percussion instruments, and particularly relates to rubber pads composed of multicolored rubber materials. This invention also relates to methods for manufacturing rubber pads for electronic percussion instruments.

2. Description of the Related Art

Conventionally, various types of electronic percussion instruments have been developed and produced, wherein electronic drums are designed to electronically simulate properties and characteristics of acoustic drums and are constituted by so-called electronic drum rubber pads (simply referred to as rubber pads), so that when users or players strike (or beat) surfaces of rubber pads, which correspond to drumheads of acoustic drums, with sticks, striking intensities are detected by percussion sensors (or impact sensors) such as piezoelectric elements, which are arranged on backsides of rubber pads, to produce detection signals, based on which corresponding electronic sounds (or drum sounds) are to be produced from electronic sound sources.

There are various playing techniques (i.e., executions) in playing acoustic drums, such as normal performance in which players strike normal areas of drumheads, and so-called rim-shot performance in which players strike rims of acoustic drums, for example. In the rim-shot performance, it is possible to produce sounds of specific tone colors, which differ from normal tone colors of acoustic drums that are played in the normal performance. Recently, electronic drums are improved to realize the aforementioned rim-shot performance and the like by incorporating various ideas. For example, it may be possible to arrange percussion sensors called rim switches in proximity to rims of rubber pads, so that strikes of rims are to be detected. Such electronic drums incorporating rim switches have already been developed.

The aforementioned percussion sensors, called "rim switches", may be normally arranged at specific positions (e.g., backsides of rubber pads), other than striking surfaces of rubber pads, in order not to be directly struck with sticks and the like. In addition, the same external design is adapted to both rim-switch-accompanied rubber pads, which are accompanied with rim switches in proximity to rims, and other rubber pads that are not accompanied with rim switches. Therefore, it is very difficult to visually distinguish between them in appearance.

Some electronic drums have both rubber pads accompanied with rim switches and other rubber pads not accompanied with rim switches. For example, an electronic drum set can be accommodated to the player (or user) like an acoustic drum set in such a way that plural rubber pads are arranged around the player. An acoustic drum set may include one or plural drums allowing the player to play rim-shot performance and the other drum(s) basically not used in rim-shot performance. For this reason, the aforementioned electronic drum set may include one or plural rim-switch-accompanied rubber pads and the other rubber pads not accompanied with rim switches. Therefore, it is necessary to make distinctions between two types of rubber pads in appearance.

All rubber pads can be accompanied with rim switches in an electronic drum set; however, this would increase the cost. Therefore, it is reasonable for electronic drum sets to be each manufactured combining two types of rubber pads. That is, it is necessary to make distinctions between them in appearance during manufacture.

Therefore, various methods are developed to make distinctions in appearance between rubber pads accompanied with rim switches and other rubber pads not accompanied with rim switches.

One method for making distinctions is to somehow change external shapes of these rubber pads, wherein prescribed marks are impressed on one of two types of rubber pads during formation, for example. However, this method requires two types of metal molds for use in manufacture of different types of rubber pads, wherein one metal mold is used for producing rubber pads having marks, and the other metal mold is used for producing other rubber pads not having marks. This increases the cost for manufacturing rubber pads.

Another method for making distinctions is to paint or print prescribed colors or marks on one of two types of rubber pads. However, this method may not guarantee sufficient durability because paints or prints may be easily peeled off from rubber pads, which are intensely struck with sticks when players play electronic percussion instruments.

A further method is to perform two-colored formation on two types of rubber pads in such a way that at least rims are formed using rubber whose color differs from that of rubber used for forming the other portions (e.g., pad portions) of rubber pads (including striking surfaces). Thus, it is possible to realize distinctions between rubber pads accompanied with rim switches and other rubber pads not accompanied with rim switches.

According to the aforementioned method, players (or users) can visually distinguish in appearance between rubber pads accompanied with rim switches and other rubber pads not accompanied with rim switches with ease. In addition, this method is advantageous in that both of the two types of rubber pads can be produced using the same metal mold. Furthermore, even when rubber pads are struck intensely, colors of rubber pads are not changed at all; therefore, the aforementioned two-colored rubber pads have sufficient durability.

However, even though rims and pad portions of rubber pads are formed using rubbers of different colors, there occurs another problem in that rubber pads may not be always produced with good external appearance because when rubber pads are each formed in a conventional shape using a conventional metal mold, color differences may not be clearly shown in boundaries between rims and pad portions, which may be intermixed in color.

A manufacturing method of a conventional rubber pad for use in an electronic percussion instrument will be briefly described with reference to FIGS. 5 to 7, wherein FIG. 5 is a cross sectional view showing an example of a conventional metal mold for use in formation of a conventional rubber pad; FIG. 6 is a cross sectional view of the conventional rubber pad, which is formed in two colors using the metal mold of FIG. 5; and FIG. 7 is a plan view showing different color divisions of the conventional rubber pad, in which a rim and a pad portion are colored differently.

In FIG. 5, compounded rubbers are put into cavities 133*a* and 133*b* formed between an upper mold 131 (realizing cavities) and a lower mold (or a core) 132 of a metal mold 130, which is then sandwiched between hot plates and is subjected to press formation (or compression formation) realizing vulcanization and pressurization, so that a conventional rubber pad is formed. As described above, two types of cavities, namely, a pad forming cavity 133*a* and a rim forming cavity 133*b*, are formed between the upper mold 131 and the lower mold 132. That is, rubbers of different colors are respectively put into the pad forming cavity 133*a* and the rim forming cavity 133*b*, wherein they are simultaneously subjected to press formation. Thus, it is possible to integrally form a rubber pad 100 (see FIGS. 6 and 7) in which a pad portion 111 and a rim portion 112 are integrally combined together.

Suppose that the rubber pad 100 is constituted by the pad portion 111 of blue color and the rim portion 112 of black color, for example. In this case, a blue-colored rubber is put into the pad forming portion 133*a*, and a black-colored rubber is put into the rim forming portions 133*b*, so that these rubbers are simultaneously subjected to press formation in the metal mold 130. During press formation, the blue-colored rubber and the black-colored rubber may be partially intermixed with each other and infiltrated in color in proximity to a boundary 133*c* of different-colored divisions between the cavities 133*a* and 133*b*.

For this reason, as shown in FIGS. 6 and 7, a blue-colored region and a black-colored region cannot be clearly distinguished and infiltrate into each other in proximity to a boundary 113 between the pad portion 111 and the rim portion 112. This makes a boundary between rubbers of different colors unclear. Therefore, even when a metal-plate body is covered with the rubber pad 100 to constitute a single pad of an electronic drum, it may be difficult to guarantee satisfactory external appearance in view of the striking surface thereof.

It may be possible to improve external appearances of rubber pads by preventing regions of different colors from infiltrating each other at boundaries therebetween. For example, different materials can be used for regions of different colors respectively. That is, a blue-colored region is made of a blue-colored plastic, and a black-colored region is made of a black-colored rubber.

However, when different materials are used for regions of different colors that join together, it is difficult to guarantee sufficient joining strength therebetween. Therefore, this method cannot be adapted to rubber pads for use in electronic percussion instruments such as electronic drums, in which relatively high impacts are caused to occur due to striking operations using sticks. In addition, this method has a drawback in that the number of steps in manufacture will be increased.

SUMMARY OF THE INVENTION

It is an object of the invention to provide a rubber pad for an electronic percussion instrument in which a pad portion and a rim portion are formed using rubbers of different colors respectively, thus distinguishing between a rubber pad accompanied with a rim switch and the other rubber pad not accompanied with a rim switch. In addition, it is an object of this invention to improve the external appearance of the rubber pad for the electronic percussion instrument by preventing regions of different colors from infiltrating each other in a boundary therebetween without deteriorating durability thereof.

It is another object of the invention to provide a method for manufacturing a rubber pad for an electronic percussion instrument, which is produced by two-colored formation using rubbers put into a metal mold with a single press.

A rubber pad of this invention for use in an electronic percussion instrument is produced by integrally forming together a pad portion (including a striking surface) and a rim portion, which are colored differently in two-colored formation. That is, a rubber of a first color is used for forming the pad portion, and a rubber of a second color is used for forming the rim portion. In addition, a groove is formed in a boundary between the pad portion and the rim portion, in which different colors may be partially intermixed together. Due to the provision of the groove, it is possible to reliably separate different colored regions, i.e., the pad portion and rim portion, from each other, which improves external appearance of the rubber pad compared with the conventional rubber pad without substantially deteriorating durability.

In order to realize the aforementioned rubber pad, there is provided a specially designed metal mold in which a partition wall actualizing the groove is arranged between a pad forming cavity and a rim forming cavity, into which rubbers of different colors are respectively put.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
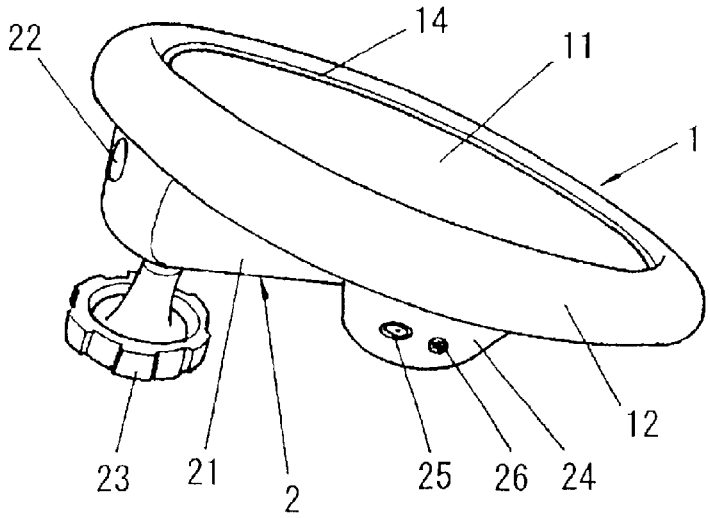
FIG. 1 is a perspective view showing the external appearance of an electronic drum pad, which is an example of a rubber pad for an electronic percussion instrument in accordance with a preferred embodiment of the invention.

FIG. 1 is a perspective view showing the external appearance of an electronic drum pad, which is an example of an electronic percussion instrument equipped with a rubber pad in accordance with the preferred embodiment of the invention.

The electronic drum pad of FIG. 1 is constituted by a rubber pad 1 and a main body 2, wherein the rubber pad 1 is arranged outside of the main body 1 and is engaged with the main body 1. The electronic drum pad is equipped with a percussion sensor (or an impact sensor) for detecting impact applied to the rubber pad 1 and a rim switch, which are incorporated in the space between the rubber pad 1 and the main body 2 and which are not exposed externally and cannot be viewed from the outside; hence, both the percussion sensor and rim switch are not illustrated in FIG. 1.

The rubber pad 1 of the electronic drum pad is constituted by a pad portion 11 having a disk-like shape, which arranges a striking surface to be struck with a stick and the like, and a rim portion 12 having a ring-like shape, which is arranged along the outer circumferential portion of the pad portion 11. Both the pad portion 11 and the rim portion 12 are integrally formed together, wherein they are made of rubbers of different colors respectively. A ring groove 14 is formed on the exterior surface of a boundary between differently colored regions, that is, between the pad portion 11 and the rim portion 12. Details of the rubber pad 1 will be described later.

The main body 2 is constituted in a disk-like shape such that the upper surface is made planar, the lower surface is slightly bent outside, and the outer circumferential portion is shaped like a flange. Therefore, the rubber pad 1 is engaged with the main body 2 in such a way that the upper surface and the flange-shaped outer circumferential portion of the main body 2 are both covered with the rubber pad 1. A projecting portion 21 is arranged on the center portion of the lower surface of the main body 2, wherein it has a slope along with the diameter direction of the disk-like shape of the main body. A fixing hole 22 is formed at a prescribed position of an external end surface of the projecting portion 21 and is elongated into the projecting portion 21.

A handle screw 23 is arranged in a direction perpendicular to the fixing hole 22 of the projecting portion 21 of the main body 2. In addition, a jack holder 24 is arranged adjacent to the side of the projecting portion 21 beneath the lower surface of the main body 2. The jack holder 24 has a pair of jacks 25 and 26 for outputting a percussion detection signal (or an impact detection signal) produced by a percussion sensor and a rim-shot detection signal produced by a rim switch.

The aforementioned projecting portion 21 and the handle screw 23 are used to install the electronic drum pad into a drum pad support member (not shown) such as a rack of an electronic drum set, for example. When installing the electronic drum pad in a rack of an electronic drum set, a support rod (not shown) is inserted into the fixing hole 22 to adjust the position (e.g., height and angle) such that the player (or user) can easily strike the electronic drum pad, and then, the handle screw 23 is tightened to fix the electronic drum pad to the electronic drum set in position.

Next, details of the rubber pad 1 will be described with reference to FIGS. 2 and 3.

Figure 2:
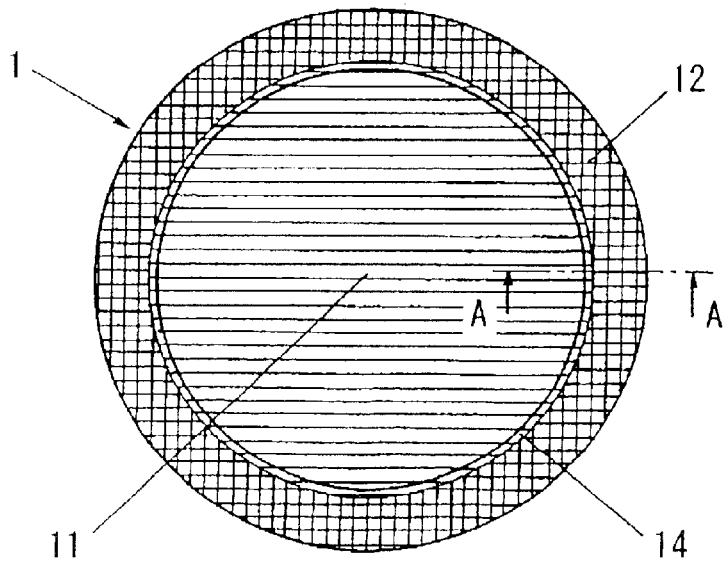
FIG. 2 is a plan view showing differently colored regions of the rubber pad in external appearance.

FIG. 2 is a plan view showing differently colored divisions or regions of the rubber pad 1 in external appearance, wherein fine horizontal lines are drawn in the pad portion 11 in order to show a blue-colored region, while meshes consisting of fine horizontal and vertical lines crossing each other are drawn in the rim portion 12 in order to show a black-colored region. FIG. 2 obviously shows that the rubber pad 1 has an external appearance consisting of the blue-colored pad portion 11 constructing the striking surface of the electronic drum pad, and the black-colored rim portion 12 that is arranged along the outer circumferential of the pad portion 11, wherein the pad portion 11 and the rim portion 12 are integrally formed together using a blue-colored rubber and a black-colored rubber, which are subjected to integral formation. Furthermore, the ring groove 14 is formed in a boundary 13 between the blue-colored pad portion 11 and the black-colored rim portion 12.

Figure 3:
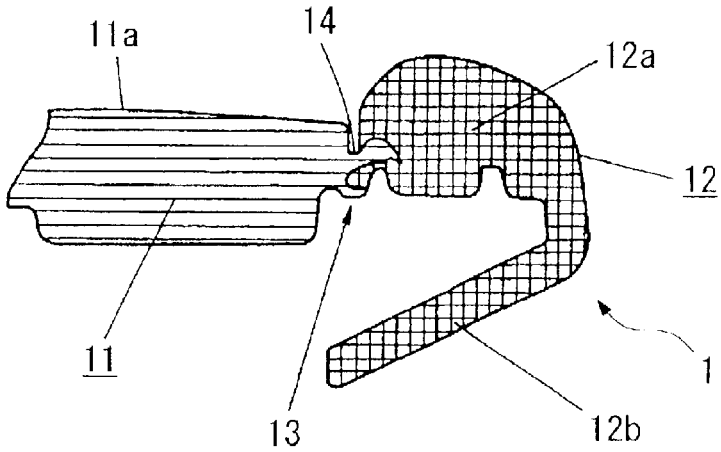
FIG. 3 is an enlarged cross sectional view taken along line A—A in FIG. 2.

FIG. 3 is an enlarged cross sectional view taken along line A—A in FIG. 2, wherein differently colored regions are respectively illustrated using fine horizontal lines and meshes similarly as in FIG. 2. In FIG. 3, the rubber pad 1 is formed in such a way that the blue-colored pad portion 11 and the black-colored rim portion 12 are mutually engaged and mixed with each other in proximity to the boundary 13 between the differently colored regions, whereas they are firmly and integrally formed together; therefore, it is possible to guarantee sufficient strength or durability against relatively intense impact.

As described above, the rubber pad 1 engages with the upper portion of the main body 2, in which a striking surface 11*a* is formed as shown in FIG. 3.

The rim portion 12 is constituted by a struck portion 12*a*, which is partially projected upwards like a ring crown to receive a rim shot applied thereto, and an engagement portion 12*b*, which is elongated downwards and is bent inwardly from the circumferential end of the struck portion 12. In order to ensure engagement with the outer circumferential portion of the main body 2, a plurality of projections and dimples are formed in interior walls of the rim portion 12.

The exterior surface of the pad portion 11 is formed substantially planar in order to form the striking surface 11*a*, while the interior surface is changed to form differences in the thickness of the pad portion 11, wherein the thickness of the pad portion 11 is increased in proximity to the rim portion 12, so that such a thick portion of the pad portion 11 is brought into contact with the main body 2.

As described above, the ring groove 14 is formed in the boundary 13 between the pad portion 11 and the rim portion 12 of the rubber pad 1. In this boundary 13, the blue-colored rubber which flowed outside of the pad portion 11 and the black-colored rubber which flowed outside of the rim portion 12 may mutually influence each other.

Due to the formation of the ring groove 14 in the boundary 13 between the blue-colored pad portion 11 and the black-colored rim portion 12, it is unlikely that the blue-colored rubber and the black-colored rubber will be mixed together. In addition, the ring channel 14 does not cause a parting effect, and as shown in FIG. 2, it is possible to noticeably improve the overall external appearance of the electronic drum pad.

In the above, the pad portion 11 and the rim portion 12 are formed using differently colored rubbers; however, they do not necessarily have the same hardness. That is, it is possible to change both the color and hardness of rubbers for use in formation of the pad portion 11 and the rim portion 12. For example, the rim portion 12 receiving a relatively intense impact is formed using a rubber whose hardness is higher than the hardness of a rubber used for forming the pad portion 11.

Next, a description will be given with respect to a method for manufacturing the rubber pad 1 by two-colored formation using rubber materials.

Figure 4:
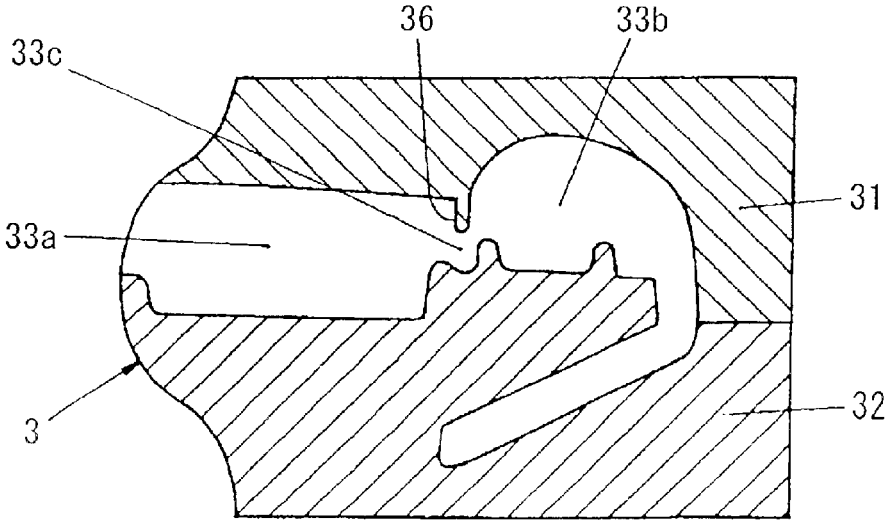
FIG. 4 is fragmental cross sectional view showing essential parts of a metal mold used for formation of the rubber pad shown in FIG. 3.
Figure 5:
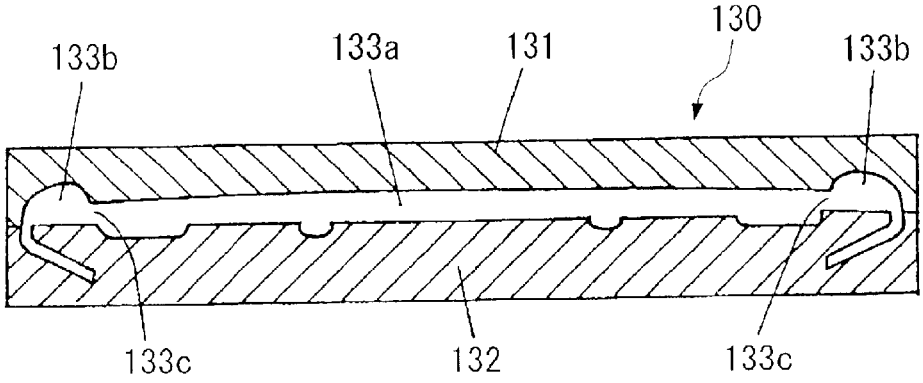
FIG. 5 is a cross sectional view showing the structure of a metal mold for use in formation of a conventional rubber pad for an electronic percussion instrument.
Figure 6:
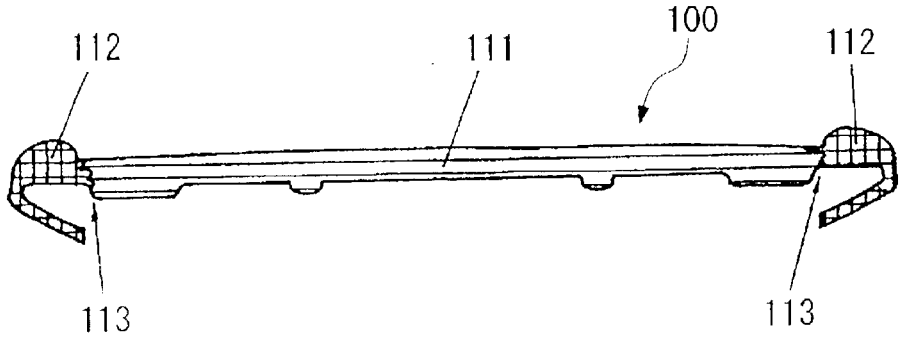
FIG. 6 is a cross sectional view showing the structure of the conventional rubber pad which is produced by two-colored formation using the metal mold of FIG. 5.
Figure 7:
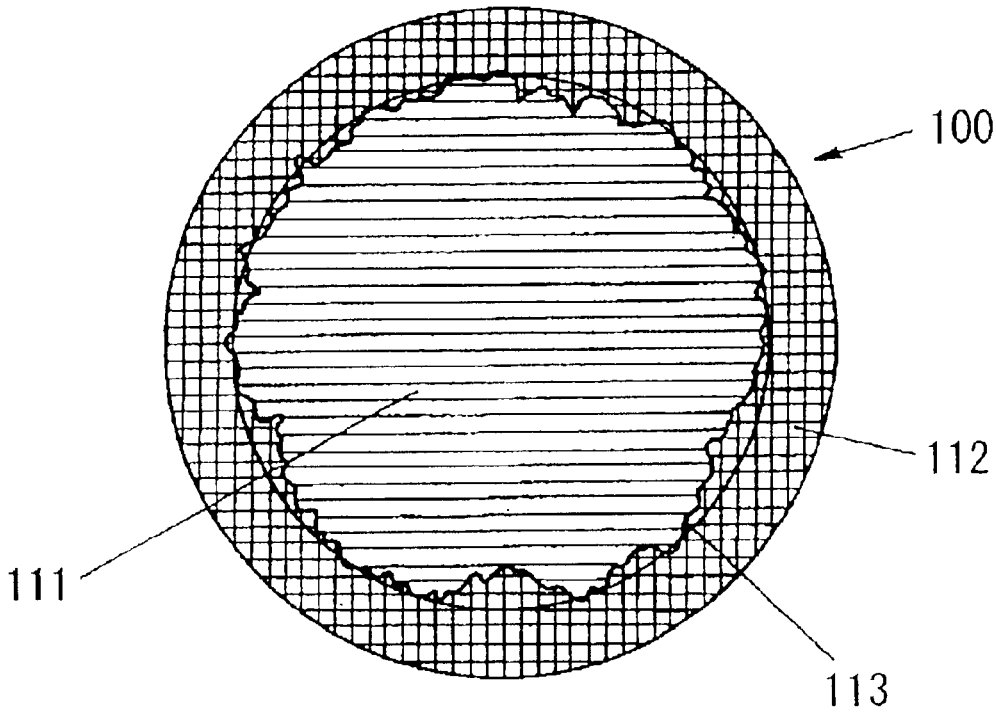
FIG. 7 is a plan view showing divisions of different colors in the external appearance of the conventional rubber pad.

FIG. 4 is a fragmental cross sectional view magnifying essential parts of a metal mold for use in formation of the rubber pad 1 described above.

That is, a metal mold 3 shown in FIG. 4 is constituted by an upper mold 31 (realizing cavities) and a lower mold (or a core) 32. Interior walls of the upper mold 31 realize formation of exterior surfaces of the pad portion 11 and the struck portion 12*a* of the rim portion 12 in the rubber pad 1. At a boundary between the interior wall of the upper mold 31 realizing formation of the exterior surface of the pad portion and the interior wall of the upper mold 31 realizing formation of the exterior surface of the rim portion 12, a partition wall 36 having a ring shape projects inwardly in the cavities of the metal mold 3 in order to form the aforementioned ring groove 14.

Interior walls of the lower mold 32 realize formation of the interior surface of the pad portion 11 and formation of the interior surface of the struck portion 12*a* and the engagement portion 12*b* of the rim portion 12. Herein, the engagement portion 12*b* is formed in an undercut space of the lower mold 32, which may seem to indicate that a molded product is difficult to extract; however, since rubber materials have elasticity, it is possible to extract a molded product from the metal mold 3.

In order to form the rubber pad 11 using the metal mold 3, the upper mold 31 and the lower mold 32 are clamped to form cavities, namely, a pad forming cavity 33*a* and a rim forming cavity 33*b*, which are partitioned from each other via the partition wall 36. Then, a blue-colored rubber is put into the pad forming cavity 33*a*, and a black-colored rubber is put into the rim forming cavity 33*b*. The metal mold 3 is then sandwiched between hot plates and is pressurized, so that the aforementioned rubbers are simultaneously subjected to vulcanized formation. That is, it is possible to actualize two-colored formation by a single press formation (or compression formation).

In the above, the black-colored rubber put into the rim forming cavity 33*b* is substantially blocked by the partition wall 36 but may be slightly leaked under the partition wall 36. That is, a small amount of the black-colored rubber may flow into the pad forming cavity 33*a* beyond a color boundary 33*c*, which defines a boundary between the blue-colored rubber and black-colored rubber.

Similarly, the blue-colored rubber put into the pad forming cavity 33*a* is substantially blocked by the partition wall 36 but may be slightly leaked under the partition wall 36. Therefore, a small amount of the blue-colored rubber may flow into the rim forming cavity 33*b* beyond the color boundary 33*c*.

The rubber pad 1 as shown in FIG. 3 is precisely formed using the metal mold 3 shown in FIG. 4, wherein the ring groove 14 is formed by the partition wall 36 on the exterior surface of the boundary 13 between the blue-colored pad portion 11 and the black-colored rim portion 12, whereas under the ring groove 14 in proximity to the boundary 13, the blue-colored rubber and the black-colored rubber are partially intermixed or infiltrate each other. As described above, the rubber pad 1 firmly interconnecting together the pad portion 11 and the rim portion 12 can be formed by a single press of the metal mold 3.

In the rubber pad 1, the ring groove 14 forms shade substantially hiding color intermixed boundary 13 from sight. That is, it may be very difficult for any person to view the color intermixed boundary 13 from the exterior; therefore, it is possible not to damage the external appearance of the rubber pad 1. Of course, colors adapted to two-colored formation of rubber materials are not necessarily limited to blue and black; therefore, it is possible to employ any combination of rubber materials of different colors.

In addition, it is possible to form the rubber pad 1 constituted by the pad portion 11 and the rim portion 12 by using other rubber materials having different colors and different hardness, wherein it is possible to integrally form the rubber pad 1 firmly interconnecting together the pad portion 11 and the rim portion 12.

Furthermore, the metal mold 3 shown in FIG. 4 can be adapted to single-colored formation in which both the pad portion and rim portion are simultaneously formed using a rubber of a single color. In this case, a ring groove is formed on the exterior surface of the boundary between the pad portion and rim portion, wherein it may construct a symbolic pattern but does not damage the external appearance of the rubber pad as a whole.

In the present embodiment, press formation (or compression formation) is used for two-colored formation using rubbers put into the metal mold 3 whose upper mold 31 has the partition wall 36 projecting downwardly, wherein a rubber pad is instantaneously produced with a single press of the metal mold 3. Of course, this invention is not necessarily limited to press formation; therefore, it is possible to use other types of formation such as transfer formation, wherein unique characteristics of rubber pads of this invention can be guaranteed as well.

According to the present embodiment described in conjunction with FIGS. 1 to 4, a rubber pad is produced by two-colored formation in such a way that a pad portion has a first color, and a rim portion has a second color. Of course, the number of colors is not necessarily limited to two; hence, it is possible to produce a rubber pad having three or more colors. For example, the other portion other than the pad portion and rim portion can be formed using a rubber of a third color, wherein a groove is formed on the exterior surface of a boundary between the third color and the first and/or second color. Since the number of colors is increased, it is possible to produce a more colorful rubber pad for an electronic percussion instrument, wherein it is possible to further improve the external appearance of the rubber pad.

For example, it is possible to produce an electronic hi-hat cymbal using a rubber pad constituted by a pad portion, a rim portion, and a cup portion, wherein the rim portion is arranged on the circumferential end of the pad portion, and the cup portion is arranged at the center of the pad portion. Herein, both the pad portion having a first color and the rim portion having a second color are formed using rubber materials of the same hardness, or they are formed using rubber materials having different hardness. In addition, a first groove is formed on the exterior surface of a boundary between the pad portion and rim portion, and a second groove is formed on the exterior surface of a boundary between the pad portion and cup portion. These grooves may reliably prevent different colors from being intermixed or infiltrating each other. Therefore, it is possible to produce a three-colored rubber pad having a good external appearance.

The rim portion can be divided into plural sections (e.g., left and right sections), which can be formed using differently colored rubbers. In this case, it is possible to produce a three-colored rubber pad in which the pad portion has a first color, and the rim portion has second and third colors.

In order to produce a rubber pad of three or more colors, the metal mold should be partially modified in such a way that the necessary number of partition walls are arranged and project downwardly from the upper mold, so that rubbers of different colors are respectively put into cavities partitioned by partition walls in the metal mold. Thus, it is possible to realize multicolor formation in which a multicolor rubber pad is instantaneously formed with a single press of the metal mold.

The aforementioned manufacturing method is not necessarily limited to production of rubber pads for electronic percussion instruments. That is, this method can be used for other purposes in manufacture of other rubber molded products.

As described heretofore, this invention has a variety of effects and technical features, which will be described below.

(1) A rubber pad for an electronic percussion instrument is produced by integrally forming together a pad portion and a rim portion by using rubbers of different colors, wherein a ring groove is formed on the exterior surface of a boundary between the pad portion and rim portion, which are differently colored. Due to the provision of the ring groove, it is possible to reliably prevent different colors from being intermixed or infiltrating each other. Therefore, it is possible to improve the external appearance of the two-colored rubber pad.

(2) In the above, the pad portion and rim portion are not necessarily formed using rubbers of different colors, and they can be formed using rubbers of a single color. That is, it is possible to produce two-types of rubber pads, i.e., a single-colored rubber pad and a two-colored rubber pad, by using a same metal mold. Since two types of rubber pads can be visually distinguished in appearance, it is possible to use two-colored formation and single-colored formation differently for a rubber pad accompanied with a rim switch and the other rubber pad not accompanied with a rim switch, which can be easily recognized.

(3) Both the pad portion and rim portion are simultaneously formed using rubbers of different colors in a single press formation, so that a color boundary has sufficient durability against impact. In addition, substantially no additional step is required in formation of a two-colored rubber pad compared with a single-colored rubber pad. Therefore, it is possible to avoid unnecessary increase of the manufacturing cost.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A rubber pad for an electronic percussion instrument, comprising:

a pad portion having a striking surface, which is made substantially planar;

a rim portion integrally interconnected with an outer circumferential portion of the pad portion, wherein the pad portion has a first color that is different from the rim portion having a second color; and a groove formed on an exterior surface of a boundary between the pad portion and the rim portion.

2. The rubber pad for an electronic percussion instrument according to claim 1, wherein the pad portion and the rim portion are formed using different rubbers having different hardness.

3. The rubber pad for an electronic percussion instrument according to claim 1, wherein the groove is formed in dimensions to prevent the first color and the second color from infiltrating each other in the boundary between the pad portion and the rim portion, which are thus securely separated from each other in color via the boundary.

4. A method for manufacturing a rubber pad for an electronic percussion instrument, comprising the steps of:

putting a rubber of a first color into a pad forming cavity of a metal mold;

putting a rubber of a second color into a rim forming cavity of the metal mold, wherein the pad forming cavity and the rim forming cavity are substantially separated from each other via a partition wall arranged inside of the metal mold; and performing a single press formation on the metal mold, thus producing a rubber pad constituted by a pad portion having the first color and a rim portion having the second color, which are integrally interconnected together and are separated from each other in color via a groove that is formed in conformity with the partition wall.

5. The method for manufacturing a rubber pad for an electronic percussion instrument according to claim 4, wherein the partition wall projects downwardly from an upper mold of the metal mold and is formed in dimensions to prevent the first color and the second color from infiltrating each other in a boundary between the pad portion and the rim portion, which are thus securely separated from each other in color via the boundary.

* * * * *